United States Patent [19]

Sundin et al.

[11] 4,233,066

[45] Nov. 11, 1980

[54] ELECTRICAL CONDUCTOR OF ALUMINIUM

[75] Inventors: Anders O. Sundin, Helsingborg; Wolfgang A. Bronnvall, Hittarp, both of Sweden

[73] Assignee: Aktiebolaget Elektrokoppar, Helsingborg, Sweden

[21] Appl. No.: 604,714

[22] Filed: Aug. 14, 1975

Related U.S. Application Data

[63] Continuation-in-part of Ser. No. 520,947, Nov. 4, 1974, abandoned, which is a continuation of Ser. No. 323,274, Jan. 12, 1973, abandoned.

[30] Foreign Application Priority Data

Apr. 27, 1972 [SE] Sweden ..... 5549/72

[51] Int. Cl.[3] ..... C22C 21/16

[52] U.S. Cl. ..... 75/142; 75/141; 148/11.5 A; 148/32

[58] Field of Search ..... 75/142, 139, 140, 141, 75/146, 147, 138; 148/32, 32.5, 11.5 A, 12.7 A

[56] References Cited

U.S. PATENT DOCUMENTS

| | | | |
|---|---|---|---|
| 1,952,048 | 3/1934 | Archer et al. | 75/147 |
| 2,826,518 | 3/1958 | Anderson | 75/138 |
| 3,582,406 | 6/1971 | Ford | 148/32 |
| 3,663,216 | 5/1972 | Hunsicker | 75/142 |
| 3,823,041 | 7/1974 | Tazaki et al. | 75/147 |

*Primary Examiner*—R. Dean

*Attorney, Agent, or Firm*—Watson, Cole, Grindle & Watson

[57] ABSTRACT

An electrical conductor with electrical conductivity of at least 59 percent of the standard conductivity for annealed copper is produced by adding to aluminium 0.001–0.10 percent by weight of beryllium, 0.05–0.35 percent by weight of copper and 0.01–0.20 percent by weight of magnesium, the total amount of beryllium, copper and magnesium being at the most 0.50 percent by weight, and forming the material into a wire or other conductor. The wire may then be heat treated. The conductor so obtained is resistant to increase in the contact resistance when exposed to heating or moisture. Pre-determined properties of the conductor can be attained under strongly varying heat treatment conditions.

12 Claims, 3 Drawing Figures

ELECTRICAL CONDUCTOR OF ALUMINIUM

RELATED APPLICATIONS

Figure 1:
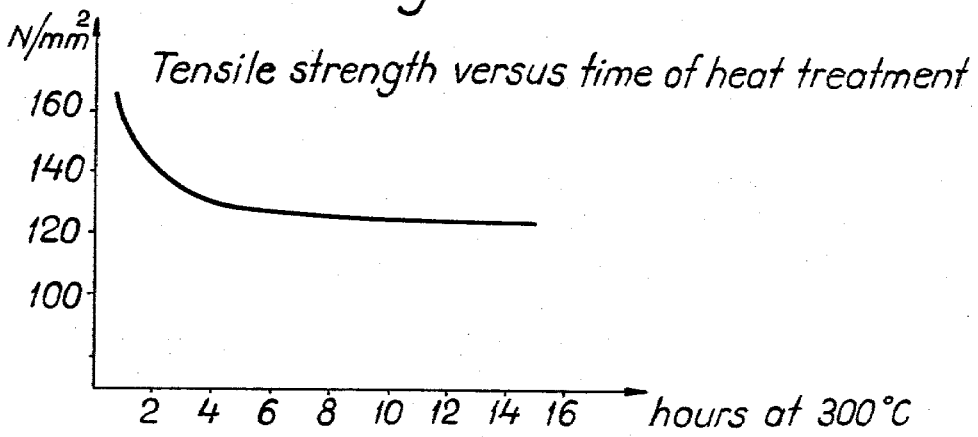

This application is a continuation-in-part of application Ser. No. 520,947, filed Nov. 4, 1974, abandoned which is a streamlined continuation of Ser. No. 323,274, filed Jan. 12, 1973, now abandoned.

BACKGROUND OF THE INVENTION

1. Field of the Invention

For aluminium as an electrical conductor material it is normally specified that the conductivity should exceed a certain minimum value. Usually, it is required that the conductivity should amount to at least 61 percent of the conductivity of annealed copper according to international standard (International Annealed Copper Standard). This means that small quantities of other elements in the aluminium, such as, for example iron and silicon, can be permitted. Sometimes a conductivity somewhat below the specified value can be accepted. This is particularly the case if other advantages are obtained, such as for example improved mechanical properties.

Aluminium as an electrical conductor material can be used, among other things, in cables, in wire for electrical machines and apparatus and in bars for, example, switchgears.

2. The Prior Art

When using aluminium as a material in electrical conductors, there are considerable difficulties in achieving an efficient, lasting contact between the conductor and connection devices, such as for example clamps and cable sockets. These difficulties are particularly pronounced if the contact between the aluminium conductor and the connection device is purely mechanical, for example when using a screw and clamp joint. Even if a good contact, that is one with low transition resistance, between the aluminium conductor and the connection device can be achieved in the attachment, it has been proved that the transition resistance increases in course of time, especially if the contact is exposed to heat and/or moisture. Efforts have been made to avoid the difficulties in different ways. Among other things, it is a well-known method to provide the aluminium surface with a coating of another metal, such as silver, tin, nickel, copper or zinc, which gives a low contact resistance to the connection device even when operated for a long period of time under varying conditions. This can be achieved for example by electroplating these metals on the aluminium surface. Also used is the method to connect a copper conductor to the aluminium conductor by means of cold-pressure welding where the conductor is to be brought into contact with the connection device. Another well-known way to try to prevent the contact resistance from increasing is to ensure that a required contact pressure is maintained all the time between the aluminium conductor and the connection device. This can be achieved by using a resilient connection device. The previously known methods either entail extra and expensive work operations or give in the long run an unsatisfactory contact with too high contact resistance between the aluminium conductor and the connection device.

Another problem with conductors of aluminium is to achieve predetermined properties in the produced product as a whole when the conductor is manufactured on a production scale. This is connected with the fact that especially the mechanical properties, such as tensile strength and elongation, are strongly dependent on the conditions during the metal working procedures.

SUMMARY OF THE INVENTION

The existing problems are solved according to the present invention which relates to an aluminium conductor which can be connected directly to a connection device giving a contact with a lasting, low contact resistance even if the contact is exposed to heat and/or moisture and also having predetermined, good mechanical properties, including good relaxation properties. It is also possible to reach a conductivity of the conductor of at least 61% IACS. The fact that the conductor has good relaxation properties means that the contact pressure between the conductor and the connection device is maintained in an efficient way. It is characteristic for the present invention that the attainment of said properties is dependent only to a very small extent on the conditions during the metal working procedures.

The present invention relates to an electrical conductor of aluminium having an electrical conductivity when unannealed of at least 59%, preferably at least 60%, and, when annealed, a conductivity of at least 61% of the conductivity for annealed copper according to international standard (International Annealed Copper Standard, IACS), characterised in that the aluminium contains 0.001–0.10, preferably, 0.01–0.05 percent by weight of beryllium, 0.05–0.35, preferably 0.05–0.24 percent by weight of copper and 0.01–0.20, preferably 0.03–0.12 percent by weight of magnesium, the total amount of beryllium, copper and magnesium being at the most 0.50 percent by weight, preferably at the most 0.40 percent by weight. The sum of the content of copper and magnesium is at least 0.12 percent by weight.

It is essential for the present invention that beryllium, copper and magnesium are incorporated in the above specified contents in order to obtain the above-mentioned properties.

The percentage of aluminium in the conductor amounts to at least 98.5 percent by weight, preferably to at least 99.0 percent by weight. A percentage of aluminium of at least 99.2 percent by weight is particularly preferred. The aluminium contains preferably silicon amounting to 0.02–0.12 percent by weight and iron amounting to 0.05–0.45 percent by weight, that is amounting to normal contents of these materials. Further the aluminium can contain small quantities of other elements such as chromium, titanium, zirconium, vanadium, molybdenum, boron, tin, zinc, cadmium, manganese, nickel, cobalt, antimony and rare earth metals.

The beryllium, the copper and the magnesium are added preferably in the form of master alloys to a melt of the aluminium but can also be added in pure form directly to the aluminium. As examples of suitable master alloys among a large number available can be mentioned a beryllium-aluminium alloy containing 5 percent by weight beryllium and 95 percent by weight aluminium, a copper-aluminium alloy containing 20 percent by weight copper and 80 percent by weight aluminium and a magnesium-aluminium alloy containing 25 percent by weight magnesium and 75 percent by weight aluminium. Also other elements which are to be included in the final product are added to the melt of the aluminium, in so far as they are not present in the raw material of the aluminium. After this, the melt is cast in accordance with conventional methods into an ingot which is transformed, by means of rolling, pressing or other forming, usually under heating, into a product of the desired shape, for example into rod, strip or bars. Often a subsequent cold-working takes place, for example rolling or drawing for manufacture of a final product having the desired dimension, for example a wire for windings. The aluminium conductor according to the present invention is preferably subjected to a heat treatment either as a final product or at an earlier stage in the manufacture. An important feature of the present invention is that the heat treatment can be carried out on the final product, that is, on the finished conductor, and that the predetermined properties of the final product can be attained also under strongly varying heat treatment conditions. The heat treatment is carried out preferably at 250°-350° C. for 0.5-20, preferably 0.5-10 hours, but can also take place under other conventionally used conditions. For some applications, for example conductor wire for overhead transmission lines, the most suitable properties in the aluminium conductor are attained without heat treatment. For other applications, for example hot extrusion of bars, the heat treatment which takes place in connection with the forming is sufficient in many cases.

Figure 2:
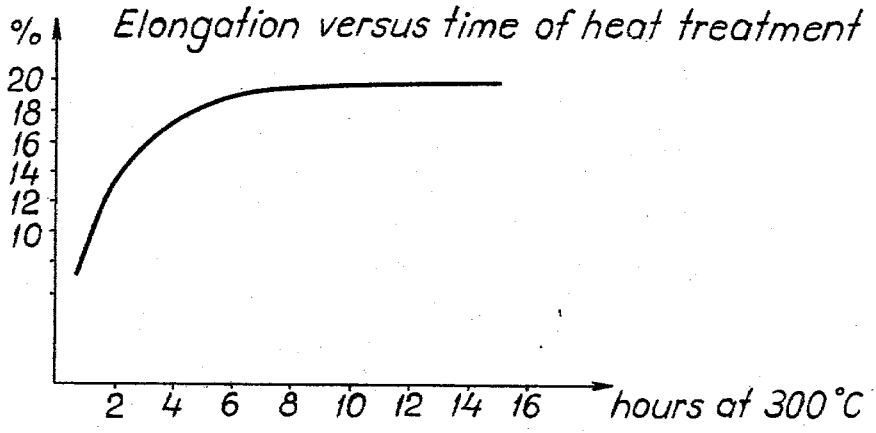
Figure 3:
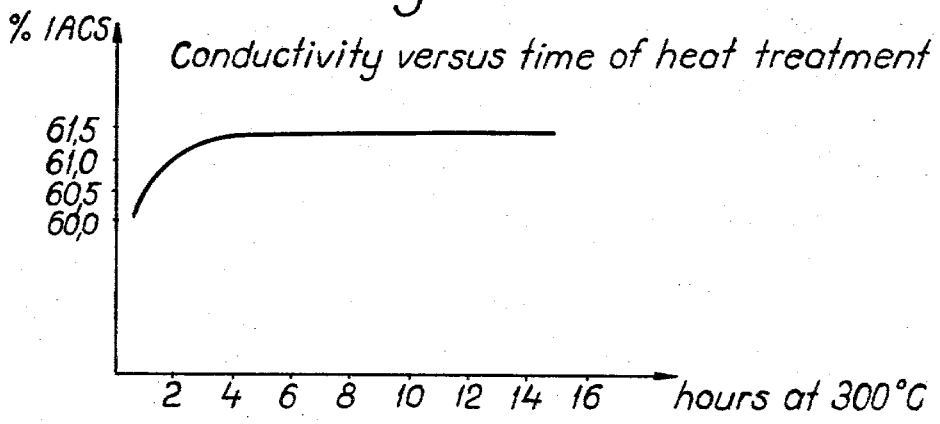

The invention will be further described in the following by means of examples and with reference to the accompanying drawing, in which FIGS. 1-3 show the properties of an aluminium conductor according to the invention.

EXAMPLE 1

99.68 parts by weight of a raw material consisting of 99.7 percent by weight aluminium, 0.17 percent by weight iron, 0.07 percent by weight silicon, 0.01 percent by weight zinc, and boron, titanium, vanadium and manganese, all in contents under 0.005 percent by weight are melted in a furnace, and to these are added 0.01 percent by weight beryllium, 0.23 percent by weight copper and 0.04 percent by weight magnesium, the beryllium, the copper and the magnesium then forming an alloy with the aluminium. The melt is cast in a Properzi-machine and hot-rolled to a rod having a diameter of 9.5 mm. This is then drawn down to a wire having a diameter of 2.0 mm in a drawing machine. After this, the wire is heat-treated by heating to about 300° C. for two hours in air. Test pieces of the obtained wire are kept together with test pieces of the corresponding wire without the beryllium, copper and magnesium additions, in heating chambers at 100° C. as well as in moisture chambers at 60° C. The contact resistance to a connection device in the form of a clamp is measured each day. Whereas the contact resistance for the test pieces with the beryllium, copper and magnesium additions is unaltered in both tests in relation to the initial value even after 400 hours, the contact resistance for the test pieces without the added elements increases both in the heating chamber and in the moisture chamber after 100 hours to more than 10 times the initial value. The tensile strength of the heat-treated wire is 13.5 kp/mm$^2$ and the elongation 13.0%. The conductivity is 61.5% IACS.

EXAMPLE 2

To 98.18 parts by weight of the raw material mentioned in Example 1 are added after melting 0.6 parts by weight of a beryllium-aluminium alloy consisting of 5 percent by weight beryllium and 95 percent by weight aluminium, further 0.5 parts of a copper-aluminium alloy consisting of 20 percent by weight copper and 80 percent by weight aluminium and finally 0.72 parts of a magnesium-aluminium alloy consisting of 25 percent by weight magnesium and 75 percent by weight aluminium. The melt is cast and treated in the way specified in Example 1. The wire obtained shows also in this case a considerably lower contact resistance after treatment in heat and moisture than the corresponding wire without additives.

EXAMPLE 3

To 99.70 parts by weight of the raw material mentioned in Example 1 are added after melting 0.02 parts by weight beryllium, 0.20 parts copper and 0.08 parts magnesium. The melt is cast and treated in the way specified in Example 1, the rod, however, being drawn down to a diameter of 1.78 mm. The heat treatment is carried out in the way specified in Example 1. The conductivity of the heat-treated wire is 61.4% IACS. In order to measure relaxation properties, the wire is clamped between a plain plate and a screw having plain end surfaces to a load of 30 kp. The residual load is measured after different periods up to 500 hours. After 500 hours the residual load is 26 kp. For a corresponding wire without additions of beryllium, copper and magnesium the corresponding value is 15 kp and the contact resistance after ageing in heat and moisture considerably higher. The tensile strength of the annealed wire is 14 kp/mm2 and the elongation 12%.

EXAMPLE 4

A wire with the composition mentioned in Example 3 is cast, rolled and drawn to a wire having a diameter of 0.50 mm. The heat treatment is carried out at 300° C. and a piece of the wire is taken out every half hour for a period of up to 15 hours and examined with regard to tensile strength, elongation and electrical conductivity. The results obtained are drawn into the diagrams in FIGS. 1-3, in which FIG. 1 shows the dependence of the tensile strength on the time of heat treatment, FIG. 2 the dependence of the elongation on the time of heat treatment and FIG. 3 the dependence of the electrical conductivity on the time of heat treatment. The diagrams show that the conductor after a short time of heat treatment attains a combination of properties which is favorable for carrying types of wire and cable conductors and that this favorable combination of properties is not lost in the continuing heat treatment.

We claim:

1. Electrical conductor consisting essentially of aluminium having an electrical conductivity when unannealed of at least 59% of the conductivity for annealed copper according to international standard (International Annealed Copper Standard, IACS), in which the conductor consists essentially of 0.001-0.10 percent by weight of beryllium, 0.05-0.35 percent by weight copper and 0.01-0.20 percent by weight magnesium, the total amount of beryllium, copper and magnesium being at the most 0.50 percent by weight, balance aluminium.

2. Electrical conductor according to claim 1, in which the content of aluminium in the conductor amounts to at least 99.0 percent by weight.

3. Electrical conductor as claimed in claim 2, in which the sum of the magnesium and copper is at least 0.12 percent.

4. Electrical conductor as claimed in claim 2, containing 0.02-0.12 percent by weight silicon and 0.05-0.45 percent by weight iron.

5. Electrical conductor as claimed in claim 1, containing 0.02–0.12 percent by weight silicon and 0.05–0.45 percent by weight iron.

6. Electrical conductor as claimed in claim 1, in which the sum of the magnesium and copper is at least 0.12 percent.

7. Electrical conductor as claimed in claim 6, containing 0.02–0.12 percent by weight silicon and 0.05–0.45 percent by weight iron.

8. Electrical conductor as claimed in claim 7, in the form of a rod, strip, bar or wire.

9. Electrical conductor as claimed in claim 6, in the form of a rod, strip, bar or wire.

10. Electrical conductor as claimed in claim 1, in the form of a rod, strip, bar or wire.

11. Annealed electrical conductor as claimed in claim 1, having an electrical conductivity of at least 61 percent (IACS).

12. Conductor as claimed in claim 1, in which the beryllium content is between 0.01 and 0.05 percent by weight.

* * * * *